United States Patent [19]

Patel

[11] 4,230,748

[45] Oct. 28, 1980

[54] FLAME SPRAY POWDER MIX

[75] Inventor: Mahesh S. Patel, Albertson, N.Y.

[73] Assignee: Eutectic Corporation, Flushing, N.Y.

[21] Appl. No.: 66,700

[22] Filed: Aug. 15, 1979

Related U.S. Application Data

[62] Division of Ser. No. 915,729, Jun. 15, 1978.

[51] Int. Cl.[3] ..... B05D 1/10

[52] U.S. Cl. ..... 427/423; 428/937

[58] Field of Search ..... 427/423; 75/252, 255, 75/0.5 R; 428/937

[56] References Cited

U.S. PATENT DOCUMENTS

| | | | |
|---|---|---|---|
| 3,313,633 | 4/1967 | Longo | 75/171 |
| 3,322,515 | 5/1967 | Dittrich et al. | 428/651 |
| 3,843,334 | 10/1974 | Cromwell | 428/937 |
| 4,019,875 | 4/1977 | Dittrich et al. | 427/423 |
| 4,039,318 | 8/1977 | Patel | 75/0.5 R |
| 4,118,527 | 10/1978 | Patel | 428/676 |

*Primary Examiner*—Shrive P. Beck

*Attorney, Agent, or Firm*—Hopgood, Calimafde, Kalil, Blaustein and Lieberman

[57] ABSTRACT

A flame spray powder mix or blend is provided for producing metal coatings on metal substrates, such as ferrous metal substrates, e.g., steel, cast iron, among other metal substrates, the powder mix comprising agglomerates of at least one oxidizable metal, e.g., aluminum, homogeneously mixed or blended with a coating metal powder, such as nickel powder. The coating produced is characterized by a strong bond and also being substantially low in dispersed oxides.

10 Claims, 4 Drawing Figures

X 160

X 160

X 160

FLAME SPRAY POWDER MIX

This is a division of copending application Ser. No. 915,729, filed June 15, 1978.

This invention relates to a flame spray powder mix and, in particular, to a flame spray powder mix constituted of agglomerates of at least one oxidizable metal mixed or blended with a coating metal powder, the mix being characterized when flame sprayed onto a metal substrate of providing an adherent bond coat low in dispersed oxides.

STATE OF THE ART

It is known to coat metal substrates with a flame spray material to protect said metal substrates, such as a ferrous metal substrate, including steel and the like, and impart thereto improved properties, such as resistance to corrosion, and/or oxidation, and/or wear and the like. The metal sprayed may be in the form of a wire or a powder, powder spraying being a preferred method.

In order to provide a metal substrate with an adherent coating, it is the practice to clean the substrate and shot blast it with steel grit or thread the surface thereof on a lathe, if the shape is cylindrical, before depositing the metal coating thereon.

In U.S. Pat. No. 3,322,515, a method is disclosed for providing an adherent coating onto a metal substrate by first cleaning the substrate and flame spraying a metal bond coat therein using a flame spray powder in which elemental nickel and aluminum are combined together to form a composite particle. This type of powder which is referred to in the trade as bond coat powder provides a basis layer by means of which a sprayed overlayer of other metals and alloys of substantial thickness is adherently bonded to the metal substrate. With this technique, fairly thick overlayers can be produced. One embodiment of the spray powder is aluminum powder agglomerated with nickel powder using a resin to provide the necessary adhesion of the two metal powders together.

The patent also states that ceramic deposits can be produced by mixing a ceramic with the nickel-aluminum composite powder, for example, 60% by weight of ceramic. Examples of ceramics are $Al_2O_3$ and carbides and silicides of Cr, Mo, W, and other refractory metals.

It is known that heated aluminum powder reacts exothermically with air to release a large amount of heat. It is believed that this mechanism is responsible in large part for the production of an adherent bond using nickel-aluminum powder in which fine aluminum powder is resin-bonded to a nickel core particle. The bond coat generally ranges in thickness from about 0.004 to 0.01 inch, as thicker coatings do not have satisfactory properties. It is also known to produce coatings of self-fluxing alloys, such as self-fluxing nickel-base alloys, in which aluminum powder is simply mixed with the nickel-base alloy powder and sprayed to produce a dense hard coating, reference being made to U.S. Pat. No. 4,031,278.

In the U.S. Pat. No. 4,039,318, a metaliferous flame spray material is disclosed, formed of a plurality of ingredients physically combined together in the form of an agglomerate, the plurality of ingredients in the agglomerate comprising by weight of about 3% to 15% aluminum, about 2 to 15% refractory metal silicide and the balance of the agglomerate essentially a metal selected from the group consisting of nickel-base, cobalt-base, iron-base and copper-base metals. A preferred combination is at least one refractory metal disilicide, e.g., $TiSi_2$, agglomerated with aluminum and nickel powder. The foregoing combination of ingredients provides coatings having improved bond strength and improved machinability.

A common ingredient of the two types of prior art agglomerated powders referred to hereinabove is aluminum. While the presence of aluminum in the agglomerate is believed to be beneficial for improving bond strength, it has been noted that the bond coat produced from agglomerated powders tends to have a dispersion of oxide therein which hardens the coating. In the case of a nickel bond coat, the coating is generally characterized by a fine dispersion of aluminum oxide and some nickel oxide. It is believed that, because the aluminum and nickel are intimately combined in the agglomerate, the violent oxidation of aluminum during flame spraying is believed to cause a rushing in of air during spraying which generally results in a coating having dispersed oxides therein. However, this is only a theory. Whatever the theory, the tendency is to form a metal coating containing substantial amounts of oxide inclusions.

The presence of fine oxides in the coating tends adversely to affect the ductility of the bond coat. A ductile bond coat is desirable in that it has a greater resistance to fretting or spalling. Moreover, an applied overcoat to the bond coat will tend to resist spalling better where the underlying bond coat is more ductile and thus capable of withstanding thermal stresses better. The ductility of the bond coat is generally indicated by its hardness. Thus, the softer the coating, the greater is the tendency for it to be more ductile.

It would thus be desirable to provide an improved coating system capable of producing on a metal substrate an adherent layer of substantial thickness which is ductile and which is low in dispersed oxides.

OBJECTS OF THE INVENTION

It is thus an object of the invention to provide a method for producing an adherent coating on a metal substrate having good bond strength and which is ductile.

Another object is to provide a flame spray powder mix comprising agglomerates of at least one oxidizable metal mixed with a coating metal making up substantially the balance of the mixture.

A further object is to provide an improved flame spray method.

These and other objects will more clearly appear from the following disclosure and the accompanying drawing, wherein.

SUMMARY OF THE INVENTION

Figure 1:
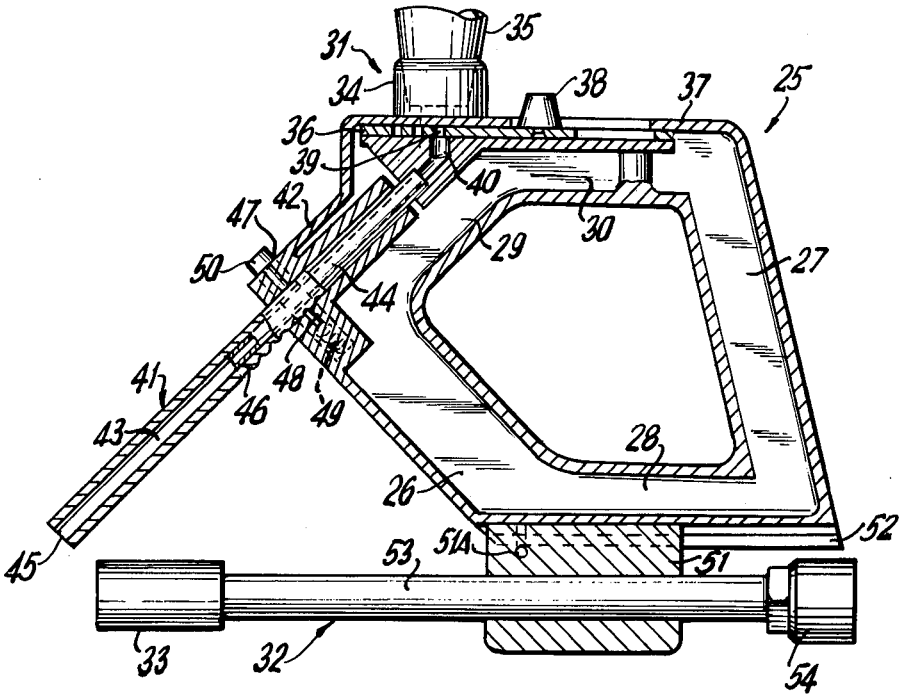
FIG. 1 depicts one type of a flame spray torch which may be employed to spray the powder mix of the invention.

One embodiment of the invention is directed to a flame spray powder mix or blend formed of agglomerates of at least one thermally oxidizable metal mixed with a coating metal powder, the average size of said agglomerates and said coating metal powder falling in approximately the same size range, for example, from about 20 to 140 microns, e.g., about 40 to 75 microns.

The term "average size" means that the average size of all the agglomerates will be such as to range substantially from about 20 to 140 microns. For example, it will be appreciated that some of the agglomerates may have sizes below 20 microns so long as the overall average of the agglomerates is 20 microns and above. Similarly, some of the agglomerates could have sizes above 140 microns so long as the overall average of the agglomerates is 140 microns or less.

What has been said for the agglomerates applies equally for the average size of the coating metal powder. The terms "powder mix" or "powder mixture" employed herein are meant to cover simple mixtures of the agglomerates and the coating metal powder, the agglomerates being discernible from the particles of coating metal under the microscope. Where the powder mixture is a mixture of the agglomerates and particles of nickel, the nickel powder can be easily separated by a magnet from the agglomerates where the agglomerates are non-magnetic.

The composition of the powder mix with respect to the oxidizable metal content may vary by weight from about 2% to 20% of the oxidizable metal, with substantially the balance the coating metal, a preferred range being about 2% to 15% by weight of oxidizable metal.

The thermally oxidizable metals are those metals which are characterized by a negative free energy of formation of the oxide of at least about 30,000 calories per gram atom of oxygen referred to 25° C. and by a melting point of above about 350° C. Examples of such metals are Cu, Be, Mg, Zn, Sr, Ba, Al, Sc, Y, La, Sb, Si, Ti, Zr, Hf, V, Nb, Ta, Type 4f rare earth metals, Cr, Mo, W, Fe, Ni, and Co.

The oxidizable metals employed in the agglomerate are also characterized by a particle size less than 20 microns, preferably not exceeding 15 microns and generally in the range of 1 to 10 microns. The smaller the particle size of the oxidizable metal in the agglomerate, the greater will be the tendency for the metal to oxidize exothermically in preference to the coarser coating metal powder because of the larger surface area of the fine particles.

Examples of thermally oxidizable metals whose oxides have a negative free energy of formation of at least about 30,000 calories per gram atom of oxygen at 25° C. are itemized as follows:

| Oxidizable Metal | The Oxide | Approximate Negative Free Energy (Calories) |
|---|---|---|
| Fe | FeO | 59,000 |
| | $Fe_2O_3$ | 60,000 |
| Co | CoO | 52,000 |
| Ni | NiO | 51,000 |
| Cu | $Cu_2O$ | 35,000 |
| | CuO | 32,000 |
| Al | $Al_2O_3$ | 125,590 |
| Be | BeO | 139,000 |
| Si | $SiO_2$ | 96,200 |
| Sb | $Sb_2O_3$ | 45,000 |
| Zr | $ZrO_2$ | 122,000 |

-continued

| Oxidizable Metal | The Oxide | Approximate Negative Free Energy (Calories) |
|---|---|---|
| Mo | $MoO_2$ | 60,000 |
| | $MoO_3$ | 54,000 |
| W | $WO_2$ | 60,000 |
| | $WO_3$ | 59,000 |

The agglomerates comprise fine particles of the thermally oxidizable metal bound together in a matrix of a fugitive binder. A fugitive binder is a thermally decomposable or vaporizable ingredient which serves as an adhesive in binding the particles together, such as a resin or an alkali metal silicate and which releases the ingredients while the powder mix is passing through the flame.

As stated hereinbefore, the average particle size of the ingredients in the agglomerate should be substantially less than the particle size of coating metal, that is, less than 20 microns, preferably less than 15 microns, and generally range from about 1 to 10 microns.

Thus, if the metal in the agglomerate has an average particle size of about 5 microns, the agglomerate will generally have an average particle size ranging from about 20 to 140 microns similar to the coating metal powder.

The coating metal mixed with the agglomerated oxidizable metal may be at least one metal from the group consisting of Ni, Co, Fe, Cu, nickel-base, cobalt-base, iron-base, copper-base alloys, and aluminum bronze.

As stated hereinbefore, the powder mixture of the invention differs from the composite agglomerate of the prior art in that the metal in the agglomerate is not combined with the coating metal, the spray powder being simply a mixture of the metal agglomerate with the coating metal.

Tests have shown that a system comprised of a mixture or blend of agglomerated aluminum and nickel powder provides a good adherent bond coat having a low hardness and being substantially clean of oxide dispersions as compared to the system in which both aluminum and nickel are agglomerated together with a resin binder. A bond coat with the latter system tends to have dispersed oxides therein and, moreover, the coating is rather hard. As stated earlier, a ductile bond coat is desirable especially when an alloy overlayer is applied to the coated substrate.

The powder mix may be sprayed using various types of metal spray torches well known in the art, particularly oxyacetylene torches. However, plasma spray torches may also be employed. Thus, the term "flame spray" used herein is meant to cover the foregoing types of torches in which the powder mix is injected into the flame, be it an oxyacetylene flame or a plasma flame and applied to the metal substrate.

A preferred torch is that disclosed in U.S. Pat. No. 3,620,454 which is adapted for gravity feed of the powder externally to the flame issuing from a nozzle, the torch being depicted in FIG. 1.

DETAILS OF THE INVENTION

In producing the metal agglomerate, the finely divided oxidizable metal powder is mixed in the proper amount with a fugitive bonding agent such as a resin or other adhesive, e.g., alkali metal silicate. One example of a fugitive bonding agent is methyl methacrylate dissolved in methyl ethyl ketone. The amount of resin employed corresponds on a dry basis with respect to the metal content of about 2% to 3% by weight following evaporation of the solvent. Broadly speaking, the amount of binder on the dry basis may range from about 1% to 5% of the total weight of the ingredients being agglomerated.

Examples of resins which may be employed are the acrylates, e.g., methyl methacrylate, and such resins as polyvinyl chloride, polyurethane, polyvinyl alcohol, and the like. The resins are employed as solutions, that is dissolved in a compatible volatile organic solvent, such as alcohols, methyl ethyl ketone (MEK), xylol, and the like, and the solution in predetermined amounts mixed with the powdered ingredients and solvent evaporated to leave behind bonded agglomerates which are sized by passing the agglomerates through a screen of 100 mesh and preferably through 140 mesh. Examples of alkali metal silicates are sodium silicate and potassium silicate which are soluble in water. The mixing and agglomeration may be carried out in a Hobart mixer manufactured by the Hobart Manufacturing Company of Troy, Ohio.

The agglomerates may also be produced by spray drying a slurry of fine metal particles. The slurry may comprise a water solution of sodium silicate containing a slurry of the metal powder of interest to be agglomerated. Spray drying is well known. A spray dryer which may be employed in producing agglomerates is one manufactured by the Bowen Engineering, Inc. of North Branch, New Jersey. Spray drying is an almost instantaneous means for producing a dry product from a slurry. This is accomplished by reducing the liquid slurry to a fine spray, mixing it with a stream of hot gas and then separating the dried agglomerate from the gas. The hot gas supplies the heat for evaporation and carries off the moisture.

APPLICATION OF THE COATING

As stated hereinbefore, while various flame spray torches may be employed for producing the coating on a metal substrate, a preferred torch is that shown in FIG. 1.

The flame spray torch 25 shown may be adapted for gravity feed of flame spray powder directly to the flame issuing from the nozzle as shown, or the powder feed may be automated by injection with a carrier gas under pressure (e.g., such as argon) from a powder feed unit.

The torch has a housing in the shape of a five-sided polygon with one leg of the polygon arranged as a handle portion 27, another leg as a base portion 28, a further leg as a feed portion 29, and another leg of the polygon as the top portion of the torch. The housing 26 has coupled to it a powder feed assembly 31 and a flame assembly 32 to which is coupled nozzle 33.

The top portion 30 is provided with a fitting 34 adapted to receive a receptacle 35 (shown fragmentarily) for holding the flame spray powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The agglomerates and powder mix flow by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33.

The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g., a steel shaft, at about six to eight inches from the workpiece.

In one embodiment of the invention, finely divided aluminum is agglomerated using a phenolic resin (e.g., phenolformaldehyde) in a solvent (ethyl alcohol) as the bonding agent to provide, following drying at 350° F. (177° C.), a retained amount of about 3% resin by weight in said agglomerates on the dry basis.

Another embodiment of the invention comprises mixing finely divided aluminum or other oxidizable metal with a sufficient amount of a 40% sodium silicate solution to provide an agglomerate after drying containing about 2 to 3% by weight of sodium silicate on the dry basis.

Following production of the agglomerates, predetermined amounts of the agglomerates of average size ranging from about 20 to 140 microns are then mixed with nickel powder of average size ranging from about 30 to 140 microns, the composition of the total mix being about 5% aluminum and 95% of Ni by weight. The powder is then flame sprayed onto a clean substrate of a 1020 steel using the oxyacetylene gravity feed torch shown in FIG. 1 to produce a strongly adherent bond coat.

As illustrative of the various additional embodiments of the invention, the following examples are given:

EXAMPLE 1

A series of tests were conducted in which the aluminum content of the mixture with nickel was varied from about 5% to 20% by weight, the aluminum being added in the form of agglomerates, the average particle size of the aluminum in the agglomerate being about 4 microns (Fisher Sub-Seive Sizer).

The aluminum was agglomerated in a Hobart mixer after adding sufficient sodium silicate solution (containing about 40% by weight of sodium silicate) to wet the powder. The mixing was carried out at a temperature of about 175° C. until the water evaporated to provide agglomerates containing about 3% sodium silicate on the dry basis. Several batches of agglomerate aluminum were produced.

Predetermined amounts of the foregoing agglomerates were then mixed with nickel to provide a range of compositions as follows:

TABLE 1

| Test No. | % Al | Average Size of Agglomerate | % Ni | Average Size of Ni |
|---|---|---|---|---|
| 1 | 2 | 20-30 microns | 98.0 | 40-75 microns |
| 2 | 5 | 20-30 microns | 95.0 | 40-75 microns |
| 3 | 7.5 | 20-30 microns | 92.5 | 40-75 microns |
| 4 | 10.0 | 30-50 microns | 90.0 | 40-75 microns |
| 5 | 15.0 | 30-60 microns | 85.0 | 40-75 microns |
| 6 | 20.0 | 30-60 microns | 80.0 | 40-75 microns |

The average bond strength was determined for each of the compositions, the results appearing in the table below:

TABLE 2

| Test No. | % Al | Bond Strength (psi) |
|---|---|---|
| 1 | 2.0 | 3,949 |
| 2 | 5.0 | 5,195 |
| 3 | 7.5 | 4,529 |
| 4 | 10.0 | 4,793 |
| 5 | 15.0 | 5,580 |
| 6 | 20.0 | 5,223 |

The percent of bonded particles at the interface following the bond test was observed to range from about 25% to 100%, the percent of bonded particles increasing with the amount of agglomerated aluminum in the powder mix.

The bond strength is determined according to ASTM designation C633-69. The determination is made by using a set of two cylindrical blocks one inch in diameter and one inch long. An end face of each block of the set is ground smooth and one face coated with the aforementioned bond coat compositions by flame spraying to a thickness of about 0.005 to 0.01 inch. A high strength overcoat is applied to the bond coat, the high strength overcoat being a nickel-base alloy known by the trade mark Inconel (7% Fe-15% Cr-balance Ni) which has a bond strength of over 10,000 psi, that is, much higher than the bond coat being tested. The thickness of the high strength overcoat is about 0.015 inch, and after depositing it, the overall coating thickness ranges up to about 0.025 inch. The overall coating thickness is then finished ground to 0.015 inch. A layer of epoxy resin is applied to the overcoat layer, the epoxy layer having a bond strength of over 10,000 psi.

The other block of the set is similarly end ground and a layer of high strength epoxy resin applied to it. The two blocks of the set, one with the metal coating and the epoxy layer is clamped to the other with the epoxy faces of the blocks in abutting contact and the clamped blocks subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined blocks using a tensile testing machine for recording the breaking force. The bonding strength is then determined by dividing the force obtained at failure by the area of the one inch circular face of the blocks.

The bond strengths of the following flame spray powders were compared using the foregoing testing procedure:

(1) Al (agglomerated)+Ni (A) ($TiSi_2$+Al+Ni) agglomerated.

(B) (Ni+Al) agglomerated.

Item (1) is a composition coming within the invention.

Item (A) is a composition derived from U.S. Pat. No. 4,039,318 in which $TiSi_2$, Al and Ni powders are all agglomerated together.

In Item (B), Ni and Al powders are agglomerated together.

The composition of each of the spray powders and the ultimate bonding strength are as follows:

| Item No. | Composition | Bond Strength |
|---|---|---|
| 1 | 5% Al—95% Ni | 5,580 psi |
| A | 4% $TiSi_2$—6% Al—90% Ni | 4,621 psi |
| B | 5.5% Al—94.5% Ni | 3,631 psi |

As will be noted, Item 1 is superior to Items A and B. Moreover, the coating produced in Item 1 tends to be cleaner and more ductile, particularly with respect to Items A and B.

Figure 2:
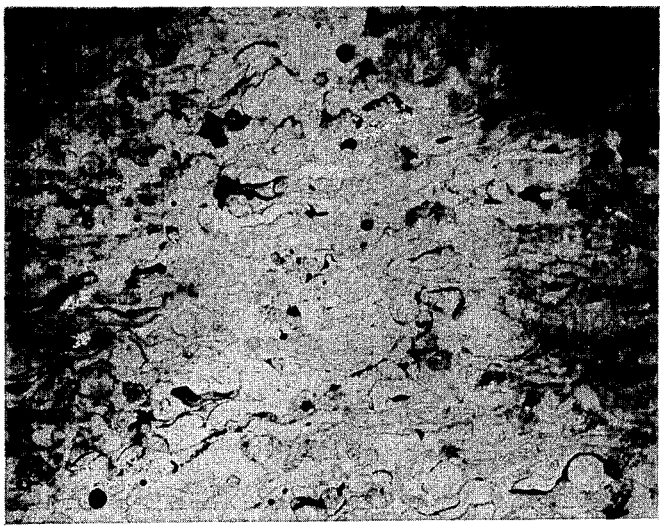
FIG. 2 is a representation of a photomicrograph taken at 160 times magnification of a cross section of a sprayed coating produced in accordance with one embodiment of the invention.
Figure 3:
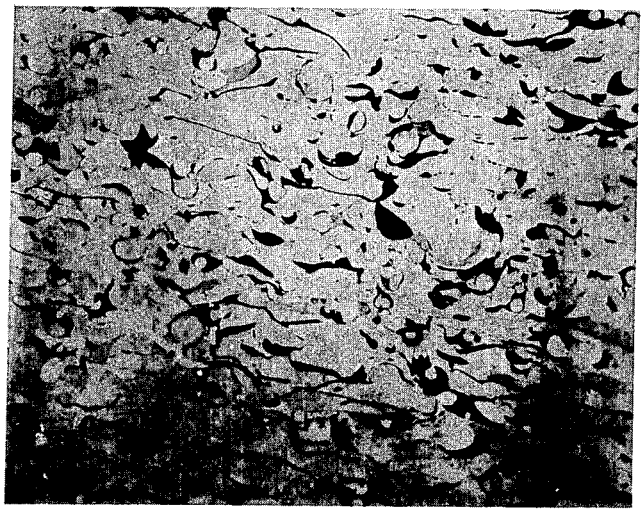
FIG. 3 is a representation of a photomicrograph taken at 160 times magnification produced from a powder agglomerate containing titanium disilicide, aluminum and nickel.
Figure 4:
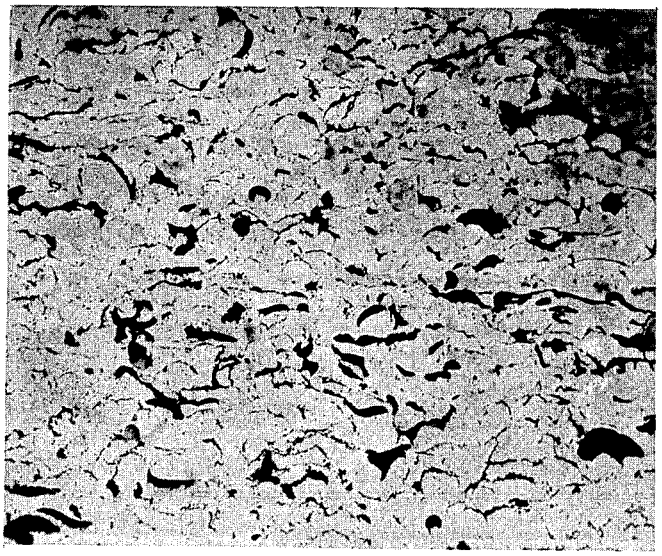
FIG. 4 is a representation of a photomicrograph taken at 160 times magnification produced from a powder agglomerate containing nickel and aluminum.

As illustrative of the soundness of the coating produced by Item 1 as compared to A and B, reference is made to photomicrographs of FIGS. 2 to 4 shown at 160 times magnification.

As will be noted, FIG. 2 (Al (agglomerated)-Ni system of the invention) is much cleaner and denser than the system of FIGS. 3 and 4. The photomicrographs of FIGS. 3 and 4 show dispersions of oxide throughout the cross section of the coatings and also some voids.

EXAMPLE 2

Similar tests were conducted as in Example 1 in which fine particles of Ni, Mg and Si were each separately agglomerated as in Example 1 and predetermined amounts of each then mixed with coarse nickel powder. The average particle size of each of the metals prior to agglomeration was as follows:

Ni—about 9 microns

Mg—about 16 microns

Si—about 10 microns

The following spray compositions were produced:

TABLE 3

| Test No. | % Element | Average Size of Agglomerate | % Ni | Average Size of Ni |
|---|---|---|---|---|
| 7 | 5 Ni | 30-70 microns | 95 | 40-75 microns |
| 8 | 5 Mg | 30-70 microns | 95 | 40-75 microns |
| 9 | 5 Si | 20-40 microns | 95 | 40-75 microns |

The average bond strength obtained for each of the spray powders on a substrate of 1020 steel is given as follows:

TABLE 4

| Test No. | % Element | Bond Strength (psi) |
|---|---|---|
| 7 | 5 Ni | 3,519 |
| 8 | 5 Mg | 5,780 |
| 9 | 5 Si | 4,952 |

As illustrative of the various spray compositions provided by the invention, the following examples are given:

| Item No. | Composition |
|---|---|
| 10 | 3.5% Be—96.5% Ni |
| 11 | 5.5% Zn—94.5% Ni |
| 12 | 8.0% Mo—92.0% Fe |
| 13 | 10.0% Ba—90.0% Ni |
| 14 | 7.5% La—92.5% Co |
| 15 | 6.0% Ti—94.0% Ni |
| 16 | 8% Nb—92.0% Cu |
| 17 | 12% Ce—88.0% Ni |
| 18 | 15% Al—85.0% Ni-base alloy (alloy contains 3% Si, 2% B, 1% Cr, 0.2% Mo and balance Ni) |
| 19 | 18% Cr—82% Ni |
| 20 | 6% W—94% Co-base alloy (alloy contains 3% Ni, 28% Cr, 1% Si, 2% B, 1% C, 4.5% W, 3% Mo and balance Co) |

| Item No. | Composition |
|---|---|
| 21 | 8% Al—92% 304 stainless steel (steel contains 0.03% max. C, 2% max. Mn, 1% max. Si, 18-20% Cr, 8-12% Ni and balance Fe) |
| 22 | 10% Al—90% aluminum bronze (alloy contains 10% Al, 2% Fe and balance Cu). |

As stated earlier, the oxidizable powder has an average particle size less than about 20 microns, generally less than about 15 microns, and generally in the range of about 1 to 10 microns, and is agglomerated to an average size ranging from about 20 to 140 microns, e.g., about 40 to 75 microns.

A wide variety of coating metals of substantially the same size range can be mixed with the agglomerated oxidizable metal.

As stated hereinbefore, examples of coating metals are nickel-base, cobalt-base, iron-base, copper-base alloys and aluminum bronze, as well as to nickel, cobalt, iron and copper per se.

The preferred alloys are those which are self-fluxing and have a melting point ranging from about 870° C. to 1288° C. (1600° F. to 2350° F.), it being understood that the alloys need not be self-fluxing. The self-fluxing alloys include those containing at least one of the metals selected from the group consisting of about 0.5% to 6% of silicon and 0.5% to 5% boron.

Examples of such alloys are given as follows:

NICKEL-BASE MATRIX ALLOY

| Constituent | Range in Percent By Weight | Example |
|---|---|---|
| Silicon | 1.5-5.0 | 3.0 |
| Boron | 1.5-5.0 | 2.0 |
| Chromium | 0-20 | 1.0 |
| Molybdenum | 0-7 | 0.2 |
| Nickel | (1) | (1) |

(1) Essentially the balance.

The foregoing alloy may be substituted in nickel content by cobalt or iron. Also, alloys or this type can consist as a matrix containing refractory carbide particles (e.g., WC) in a fine particle size to effect a further improvement in abrasion resistance. The following matrix alloy may be employed.

COBALT-BASE MATRIX ALLOY

| Constituent | Range in Percent By Weight | Example |
|---|---|---|
| Nickel | 1. -5.0 | 3.0 |
| Chromium | 20.0-32.0 | 28.0 |
| Silicon | 0.5-3.0 | 1.0 |
| Boron | 1.0-3.0 | 2.0 |
| Carbon | 0.8-2.0 | 1.0 |
| Tungsten | 3.5-7.5 | 4.5 |
| Molybdenum | 0.0-5.0 | 3.0 |
| Cobalt | (1) | 57.5 |

(1) Essentially the balance.

Again, nickel or iron may be substituted in the above formulation for a like amount of cobalt.

A particularly preferred copper-base matrix alloy which has been found useful has the following constituents in percentages by weight as indicated:

COPPER-BASE ALLOY

| Constituent | Broad Range | Intermediate Range |
|---|---|---|
| Nickel | 15.0-40.0 | 20-25 |
| Silicon | 5.0 | 3.0-4.0 |
| Boron | 0.15-2.50 | 0.25- 0.5 |
| Manganese | 0.20-2.00 | 0.5-1.0 |
| Copper | (1) | (1) |

(1) Essentially the balance.

As an example of a matrix alloy within the above ranges, there may be mentioned:

| Constituents | Percent by Weight |
|---|---|
| Nickel | 23.00 |
| Silicon | 3.45 |
| Boron | 0.47 |
| Manganese | 0.75 |
| Copper | (1) |

(1) Essentially the balance.

The foregoing alloys are preferably employed as atomized powders. A particular nickel-base alloy is one containing about 3% Si, 2% B, 1% Cr, 0.2% Mo and the balance essentially nickel. It is preferred that the average size of the coating metal range from minus 200 mesh to plus 325 mesh.

As-sprayed coatings of substantial thickness may be produced in accordance with the invention, e.g., coating thicknesses of up to about 0.25 inch, e.g., about 0.01 to 0.125 inch.

While the sprayed metal coating of the invention has shown particular applicability to the coating of ferrous metal substrates, the sprayed metal coating is also compatible with metal substrates comprising nickel, cobalt, aluminum-base alloys and copper substrates, among other compatible metal substrates.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of producing an adherent bond coat on a metal substrate which comprises, flame spraying onto said metal substrate a powder mixture formed of agglomerates of an oxidizable metal separately mixed with a coating metal powder, the average size of said agglomerates and said coating metal powder ranging from about 20 to 140 microns, said agglomerates being made up of fine particles of said oxidizable metal of average size less than about 20 microns bound together in a matrix of a fugitive binder, said oxidizable metal being characterized by a negative free energy of formation of the oxide of at least 30,000 calories per gram atom of oxygen referred to 25° C. and a melting point above 350° C., the composition of said powder mixture ranging from about 2% to 15% by weight of said oxidizable metal, with substantially the balance said coating metal powder, and continuing said spraying to form an adherent bond coat on said substrate characterized by improved bond strength.

2. The method of claim 1, wherein the amount of oxidizable metal ranges from about 2% to 10% by weight.

3. The flame spray method of claim 1, wherein the coating metal is selected from the group consisting of Ni, Co, Fe, Cu, nickel-base, cobalt-base, iron-base, copper-base alloys and aluminum bronze.

4. A method of producing an adherent bond coat on a metal substrate which comprises, flame spraying onto said metal substrate a powder mixture formed of agglomerates of at least one oxidizable metal selected from the group consisting of Cu, Al, Be, Mg, Zn, Sr, Ba, Sc, Y, La, Sb, Si, Ti, Zr, Hf, V, Nb, Ta, Type 4f rare earth metals, Cr, Mo, W, Fe, Ni, and Co separately mixed with a coating metal powder, the average size of said agglomerates and said coating metal powder ranging from about 20 to 140 microns, said agglomerates being made up of fine particles of said oxidizable metal of average size less than about 20 microns bound together in a matrix of fugitive binder, the composition of said powder mixture ranging from about 2% to 15% by weight of said oxidizable metal, with substantially the balance said coating metal powder, and continuing said spraying to form an adherent bond coat on said substrate characterized by improved bond strength.

5. The method of claim 4, wherein the amount of oxidizable metal ranges from about 2% to 10% by weight.

6. The flame spray method of claim 4, wherein the coating metal is selected from the group consisting of Ni, Co, Fe, Cu, nickel-base, cobalt-base, iron-base, copper-base alloys and aluminum bronze.

7. A method of producing an adherent bond coat on a metal substrate which comprises, flame spraying onto said metal substrate a powder mixture formed of agglomerates of aluminum separately mixed with a coating metal powder, the average size of said agglomerates and said coating metal powder ranging from about 20 to 140 microns, said agglomerates being made up of fine particles of said aluminum of average size less than about 20 microns bound together in a matrix of a fugitive binder, the composition of said powder mixture ranging from about 2% to 15% by weight of said aluminum with substantially the balance said coating metal powder, and continuing said spraying to form an adherent bond coat on said substrate characterized by improved bond strength.

8. The method of claim 7, wherein the amount of aluminum ranges from about 2% to 10% by weight.

9. The flame spray method of claim 7, wherein the coating metal is selected from the group consisting of Ni, Co, Fe, Cu, nickel-base, cobalt-base, iron-base, copper-base alloys and aluminum bronze.

10. The flame spray method of claim 7, wherein the coating metal powder is nickel.

* * * * *